US006202223B1

(12) United States Patent
Chartrand

(10) Patent No.: US 6,202,223 B1
(45) **Date of Patent: *Mar. 20, 2001**

(54) PADDING WITH EMBEDDED FASTENER FOR USE IN A HELMET

(75) Inventor: Daniel Chartrand, Deux-Montagnes (CA)

(73) Assignee: Bauer Nike Hockey Inc. (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/980,370

(22) Filed: Nov. 28, 1997

(30) Foreign Application Priority Data

Nov. 29, 1996 (CA) ..... 2191683

(51) Int. Cl.[7] ..... A42B 1/06

(52) U.S. Cl. ..... 2/410; 2/414; 411/823; 411/180

(58) Field of Search ..... 2/410, 411, 414, 2/418, 417, 419, 421, 422, 424, 455, 425, 16, 24; 403/21, 22; 411/180, 82.3, 930; 52/125.5; 24/105

(56) References Cited

U.S. PATENT DOCUMENTS

| | | | | |
|---|---|---|---|---|
| 3,348,596 | * | 10/1967 | Leitner | 411/180 |
| 3,568,210 | | 3/1971 | Marietta | 2/3 |
| 3,720,955 | | 3/1973 | Rawlings | 2/3 R |
| 4,282,610 | | 8/1981 | Steigerwald et al. | 2/414 |
| 4,484,364 | * | 11/1984 | Mitchell et al. | 2/414 |
| 4,677,694 | * | 7/1987 | Crow | 2/425 |
| 4,853,980 | * | 8/1989 | Zarotti | 2/414 |
| 4,980,110 | | 12/1990 | Nelson et al. | 264/152 |
| 5,718,004 | * | 2/1998 | Broersma et al. | 2/425 |

FOREIGN PATENT DOCUMENTS

| | | |
|---|---|---|
| 1 147 501 | 6/1983 | (CA) . |
| 4421 110 | 4/1983 | (DE) . |
| 32 32 762 A1 | 12/1995 | (DE) . |

* cited by examiner

*Primary Examiner*—John J. Calvert
*Assistant Examiner*—Gary L. Welch
(74) *Attorney, Agent, or Firm*—Finnegan, Henderson, Farabow, Garrett & Dunner LLP

(57) ABSTRACT

A protective helmet having a rigid outer helmet shell, an inner pad assembly formed from a resilient material and threaded fasteners partially embedded in the inner pad assembly and adapted to secure the inner pad assembly into the outer helmet shell. The embedded fastener has a threaded aperture to receive a securement means such as a threaded screw, and a non-circular portion, which protrudes from the inner pad assembly and is inserted in a corresponding mounting hole on the outer helmet shell. The non-circular portion of the fastener prevents rotation of the fastener when the threaded securement means is fastened into the threaded aperture during installation or removal of the inner padding assembly.

41 Claims, 2 Drawing Sheets

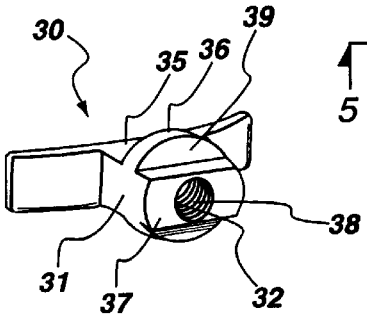
Fig.3
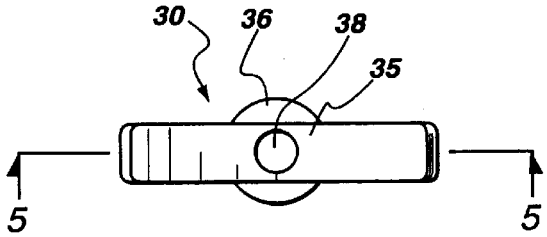
Fig.4
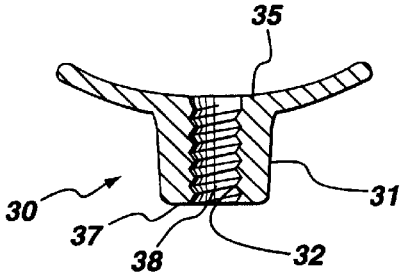
Fig.5
Fig.6a
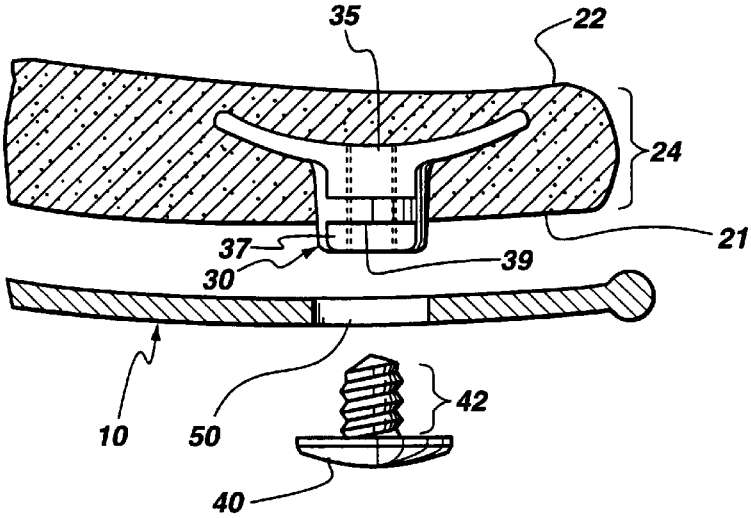
Fig.6b
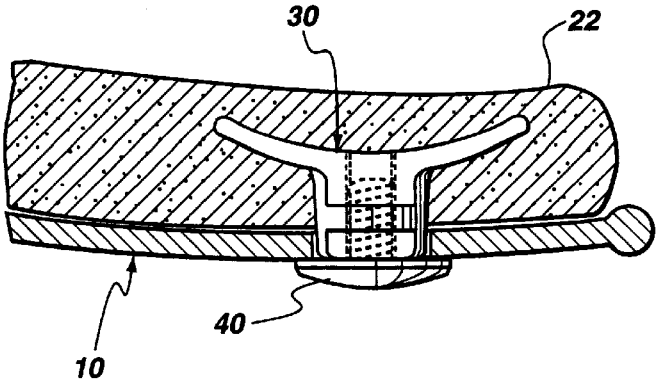

PADDING WITH EMBEDDED FASTENER FOR USE IN A HELMET

FIELD OF THE INVENTION

The present invention is directed to protective helmet suitable for use by an occupant or operator of a racing car, motorcycle or the like or for use in sporting activities such as football, bicycling, lacrosse, hockey and the like, and more particularly to a pad assembly for use in this protective helmet and comprising a fastener system which attaches the inner resilient pad to an outer rigid helmet shell.

BACKGROUND OF THE INVENTION

The use of protective headgear in various types of sports or hazardous activities is well known. Conventional protective helmets have one or more inner pads secured by fasteners to the inner surfaces of a rigid helmet shell and are generally adapted to conform to the shape of a wearer's bead. One of the problems associated with the use of such helmet arises when the inner pads of the helmet are not properly fitted to the head of the user. Another disadvantage of known helmets is that the inner pads of the helmet are attached by metal rivets which do not permit removal of the inner pads and which may protrude into the helmet resulting in injury to the wearer upon impact.

SUMMARY OF THE INVENTION

It is an object of the present invention to provide a protective helmet which comprises an outer rigid helmet shell and one or more releasably attached inner pad assemblies.

It is another object of this invention to provide an improved fastener system for use in protective helmet which releasably attaches an inner pad to an outer rigid helmet shell.

It is another object of this invention to provide a novel protective helmet including a helmet shell having one or more pad assemblies releasably secured to an inner surface of the helmet shell, each pad assembly having an integrally formed fastener, and wherein the fastener secures the pad assembly to the helmet shell in a fixed orientation thereby eliminating rotation between the helmet shell and the pad assembly.

In accordance with the present invention, there has been provided a novel pad assembly for use in a protective helmet shell, said pad assembly formed from a resilient material and comprising a back surface defining a helmet shell contacting surface, a front surface defining a wearer contacting surface, and side surfaces connecting said back and front surfaces, said pad assembly further comprising a fastener embedded into said pad assembly and extending outward from the back surface of said pad assembly, said fastener having base means for retaining said fastener to said pad assembly, post means adapted to conform to a mounting hole in said helmet shell, said post means and said mounting hole being of substantially corresponding shape whereby said post means is capable of being inserted into said mounting hole, so that said post means are non-rotatably mounted in said mounting hole.

Also provided in accordance with the present invention is a protective helmet comprising an outer rigid helmet shell shaped to protect the top, rear, front and sides of a wearer's head, and an inner pad assembly formed from a resilient material and comprising a back surface defining a helmet shell contacting surface, a front surface defining a wearer contacting surface, and side surfaces connecting said back and front surfaces, said pad assembly further comprising a fastener imbedded into said pad assembly and extending outward from the back surface of said pad assembly, said fastener having base means for retaining said fastener to said pad assembly, post means adapted to conform to a counting hole in said helmet shell, said post means and said mounting hole being of substantially corresponding shape whereby said post means is capable of being inserted into said mounting hole, so that said post means are non-rotatably mounted in said mounting hole, said protective helmet further comprising securement means for attaching said helmet shell to said pad assembly.

BRIEF DESCRIPTION OF THE DRAWINGS

FIG. 3 is a perspective view of the fastener of the present invention.

FIG. 4 is a side view of the fastener illustrating the base portion of the fastener.

FIG. 5 is a fragmentary sectional view of the main body taken substantially as indicated along the line 5—5 of FIG. 4.

FIGS. 6*a* and 6*b*, respectively, show the fastener of the present invention in a fastened position and an unfastened position.

DESCRIPTION OF THE PREFERRED EMBODIMENTS

Figure 1:
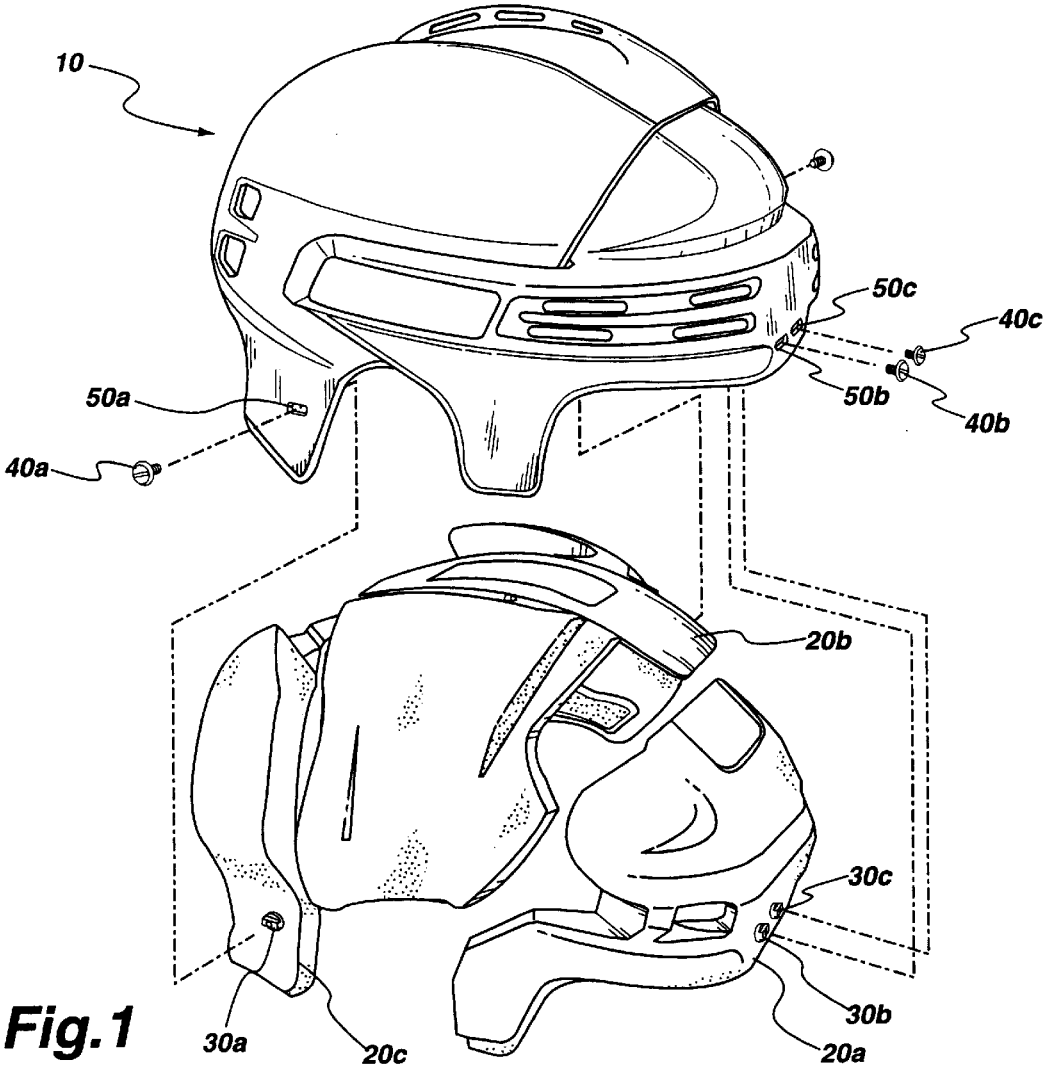
FIG. 1 is an exploded perspective view of the protective helmet of the present invention illustrating the helmet shell, pad assembly and fastener components.
Figure 2:
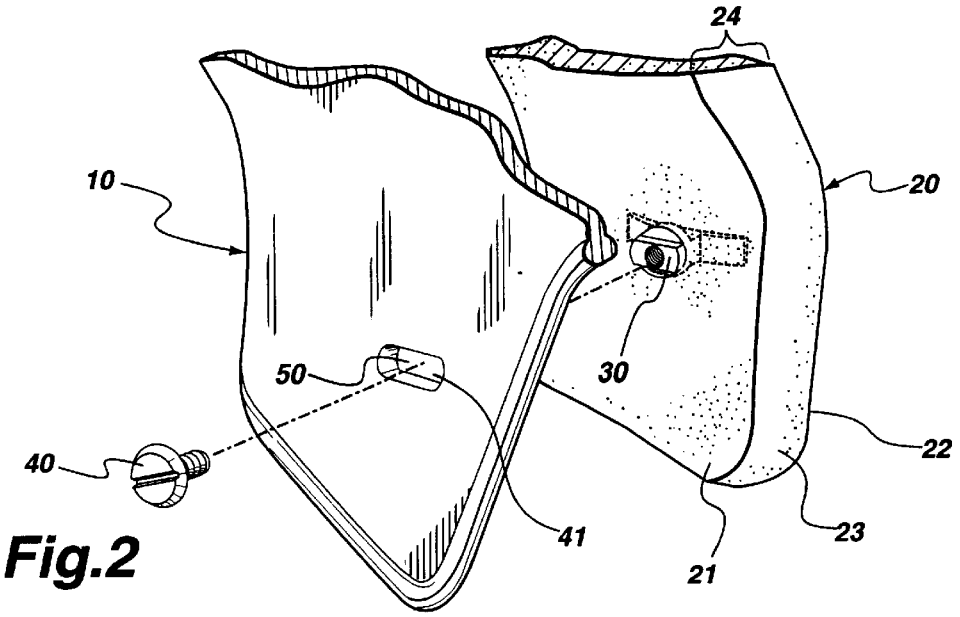
FIG. 2 is an exploded perspective view illustrating the pad assembly and associated fastener and the manner of securing the pad assembly to the helmet shell.

Referring to FIGS. 1 and 2, there is shown a protective helmet comprising an outer helmet shell 10 which is preferably made of a relatively rigid material, such as a polycarbonate alloy, a rigid thermoplastic, or a thermosetting resin. The helmet shell 10 is provided with a plurality of mounting holes 50*a*, 50*b* and 50*c*, each one having a shape which substantially conforms to a post part of a fastener, as hereinafter described, which in inserted into the mounting hole and releasably secured therein by securement means 40.

The protective helmet further comprises a pad assembly 20 positioned within the helmet shell 10 to dissipate forces applied against the helmet shell 10 thereby protecting a wearer's head from the applied forces. The pad assembly 20 is releasably secured to the inner surface of the helmet shell 10 by means of fastener 30 which interconnects the pad assembly 20 to the helmet shell 10 with securement means 40 shown, for illustrative purposes, as a threaded screw. The securement means 40 establishes a stable but releasable connection between the helmet shell 10 and the pad assembly 20.

FIG. 1 illustrates a preferred embodiment of the present invention wherein the protective headgear comprises an outer helmet shell and three separate pad assemblies, wherein a first pad assembly is secured to a front portion of the helmet shell, a third pad assembly is secured to a rear portion of the helmet shell and a second pad assembly is slidably attached to the first and third pad assemblies, the first, second and third pad assemblies covering substantially the entire inner surface of the helmet shell. In this embodiment, the pad assembly 20 generally includes three slidably connected pads 20*a*, 20*b* and 20*c* respectively, wherein pad 20*a* is secured to a front portion of the helmet shell by inserting fasteners 30*b* and 30*c* through mounting holes 50*b* and 50*c* respectively, and utilizing securement means 40*b* and 40*c* to provide a releasable connection between the helmet shell 10 and the pad assembly 20*a*. Similarly, pad 20*c* is secured to a rear portion of the helmet shell by inserting fastener 30*a* through mounting hole 50*a* and securement means 40*a*. Pad 20*c* is similarly attached or affixed to an opposite side of helmet shell 10 which is not shown in the figures. In accordance with this embodiment of the invention, central pad 20*b* is slidably connected to pads 20*a* and 20*c* by means of interlocking tongue means and is not secured to the helmet shell.

The pad assembly 20 of the present invention may be formed from any resilient, moldable, shock absorbing materials such as a foamed styrene polymer, a foamed urethane polymer or other rigid foam-like material being light in weight and having shock absorbing properties. The pad assembly 20 has a back surface 21 defining a helmet shell contacting surface, a front surface 22 defining a wearer contacting surface, and side surfaces 23 connecting said back and front surfaces and defining a thickness 24 of the pad assembly 20. The pad assembly 20 may have its outer surfaces treated to provide washable surfaces of the pads, for example, by dipping the pads in a suitable material such as liquid vinyl, urethane or latex. In addition, the pad assembly may have a densified outer layer defining either the front surface 22, the back surface 21 or both the front and back surfaces. The process of densifying a pad assembly is more fully disclosed in U.S. Pat. No. 4,282,610, which is incorporated herein in its entirety.

Referring to FIGS. 2–5, the pad assembly further comprises a fastener 30 having a base portion 35 defining a first end which is embedded into the pad assembly, a post part 37 defining a second end which extends outward and protrudes from the back surface of the pad assembly. The base portion 35 functions to prevent the fastener 30 from being pulled from the pad assembly 20 and the non-circular post part functions to prevent rotary and lateral deflection of the pad assembly 20 with respect to the helmet shell 10. The fastener 30 has an outer surface 31 and an inner surface 32, said inner surface defining a threaded aperture 38 extending longitudinally from the post part 37 to the base portion 35 through a central portion of the fastener. The threaded aperture 38 preferably has a diameter and helical threads which are adapted to accept a securement means 40 in the form of a threaded screw. The outer surface 31 of the fastener 30 has top and bottom side walls and left and right side walls, and includes the base portion 35 defining the first end of the fastener, the non-circular post part 37 defining the second opposite end of said fastener 30, and a support flange 36 intermediate the base portion 35 and the post part 37. As shown in FIGS. 6*a* and 6*b*, the base portion 35 and the support flange 36 of fastener 30 are embedded within the thickness of the pad assembly 20 such that base portion 35 is intermediate the front surface 22 and the back surface 21 of the pad assembly 20. More specifically, it is important that the base portion 35 be spaced from the front surface 22 of the pad assembly 20 by an amount in excess of the expected deformation of the pad upon impact with an applied force. The base portion 35 extends laterally outward from at least two opposite side walls of the fastener and has a major surface which is generally parallel to the front and back surfaces of the pad assembly 20. The base portion should extend in a lateral direction extending outward from the longitudinal threaded aperture 38 to an extent which is sufficient to anchor the fastener 30 into the pad assembly 20 and prevent its removal from the pad. The shape of the base portion 35 of fastener 30 is not, per se, critical to the invention, provided of course that it extends laterally outward from the side walls of fastener 30 in an amount sufficient to prevent the fastener 30 from being removed from the pad assembly 20. Accordingly, base portion (35) may be in the form of a circular or elliptical disk or may be in the form of one or more laterally extending rigid, substantially planar surfaces, such as for example two, three, four or more laterally extending legs in a manner similar to spokes emanating from a central hub. It is preferred that the base portion 35 be non-circular so as to prevent rotation of the fastener 30 within the pad assembly 20 and thereby provide correct alignment between the pad assembly 20 and the helmet shell 10. Base portion 35 is preferably in the form of an elongated rectangle formed by two legs extending from opposite side walls of fastener 30 or in the form of a cross formed by four legs extending laterally outward from the side walls and having an angle of 90 degrees between adjacent legs.

Referring to FIG. 3, the support flange 36 has an upper surface 39 which is preferably co-planar with the back surface 21 of the pad assembly 20. The support flange 36 extends laterally outward from opposite side walls of the fastener in a length which is greater than the width of the post part 37 but which is less than the lateral length of the base portion 35. The shape of support flange 36 is not, per se, critical to the invention provided that it is larger than the post part 37, and is capable of supporting helmet shell 10 when pad assembly 20 is releasably secured to helmet shell 10 as shown in FIG. 6*b*. In a preferred embodiment, the base portion 35 comprises a pair of laterally extending legs which extend from opposite left and right side walls, and the support flange 36 comprises a pair of semi-circular surfaces 39 which extend laterally outward from the side walls of fastener 30 in a direction substantially perpendicular to the longitudinally extending threaded fastener 38.

Securement means 40 may comprise any conventional releasable fastener such as threaded screws, bolts, rib fasteners, spring clips, and the like. It is preferred that the securement means comprises a threaded screw. While the fastener and securement means can be constructed from suitable materials such metals, nylon-type materials, plastics, and the like, it is preferred that the fastener and securement means be constructed of plastics or nylon-type materials to provide added protection to a wearer of the helmet.

As shown in FIGS. 6*a* and 6*b*, in use, the post part 37 is inserted into a mating mounting hole 50 formed in the helmet shell (10). The length of post part 37 is chosen in such a way that, after the post part 37 is inserted into mounting hole 50, and secured with securement means 40, an inner surface of helmet shell 10 contacts surfaces 39 of support flange 36 on fastener 30 as shown in FIG. 6*b*. Thus, the length of the post part 37 generally corresponds to the thickness of the outer shell of the helmet shell such that when the non-circular post part is engaged in the mating mounting hole in the helmet shell, the inner surface of the helmet shell contacts the support flange 36 and the outer surface of the helmet shell in co-planar with post part 37 or optionally extends beyond post part 37. In this manner, when the threaded screw is engaged in the fastener, the helmet shell is securely attached to the pad assembly.

The pad assembly of the present invention may be made by conventional injection molding techniques wherein fastener 30 is placed in a suitably shaped pad mold and a foamed polymer is injected therein, the polymer is permitted to cure into a rigid structure, and the pad assembly is then removed from the pad mold.

In assembling the protective helmet of the present invention, a pad assembly 20 is placed in position in a helmet shell 10, wherein the fastener 30 is aligned with mounting hole 50 in the helmet shell 10, the non-circular post part 37 is inserted into the correspondingly shaped mounting hole 50 and is releasably secured in place by means of securement means 40. As illustrated in FIGS. 6*a* and 6*b*, the securement means 40 is in the form of a threaded screw, having threaded screw post 42 which extends through mounting hole 50 in helmet shell 10 and is engagingly housed in the threaded aperture 38 of the fastener 30.

With respect to the above description, it is to be realized that the optimum dimensional relationships for the parts of the invention, to include variations in size, materials, shape, form, function and manner of operation, assembly and use, are deemed readily apparent to one skilled in the art, and all equivalent relationships to those illustrated in the drawings and described in the specifications are intended to be encompassed by the present invention.

What is claimed is:

1. A pad assembly for use in a protective helmet shell, said pad assembly formed from a resilient foam material and comprising a back surface defining a helmet shell contacting surface, a front surface defining a wearer contacting surface, said pad assembly further comprising a threaded fastener first component adapted for receiving a second fastener component, said first component extending through the back surface of said pad assembly, said first component having base means embedded into said foam material for retaining said first component to said pad assembly, a non-circular post means adapted to fit into a non-circular mounting hole in said helmet shell and capable of being inserted into said mounting hole, so that said post means is non-rotatably mounted in said mounting hole thereby preventing rotation of said threaded fastener first component when said second fastener component is engaging said first component during installation of said pad assembly to said helmet shell.

2. A pad assembly as defined in claim 1, wherein said post part and said mounting hole serve as non-rotatable positioning and securement means between the pad assembly and said helmet shell.

3. A pad assembly as defined in claim 1, wherein said base means of said fastener comprises lateral extensions to prevent rotation of the fastener within said pad assembly.

4. A pad assembly as defined in claim 1, wherein said fastener further comprises a flange means located between the base means and the post means, said flange means adapted to support said helmet shell against said fastener.

5. A pad assembly as defined in claim 4, wherein the length of said post means is at most equal to the depth of said mounting hole in said helmet shell.

6. A pad assembly as defined in claim 5, wherein said rear pad assembly has a threaded fastener located on each side of the helmet in the lower part of a rear portion of said outer rigid helmet shell.

7. A pad assembly as defined in claim 6, wherein the length of said post means is at most equal to the depth of said mounting hole in said helmet shell.

8. A pad assembly as defined in claim 4, wherein said base means of said fastener comprises lateral extensions to prevent rotation of said fastener within said pad assembly.

9. A pad assembly as defined in claim 8, wherein said post part and said mounting hole serve as non-rotatable positioning and securement means between said pad assembly and said helmet shell.

10. A pad assembly for use in a protective helmet shell, said pad assembly formed from a resilient foam material and comprising a back surface defining a helmet shell contacting surface, a front surface defining a wearer contacting surface, said pad assembly further comprising a threaded fastener first component adapted for receiving a second fastener component, said first component extending through the back surface of said pad assembly, said first component having base means embedded into said foam material for retaining said first component to said pad assembly, a non-circular post means adapted to fit into a non-circular mounting hole in said helmet shell and capable of being inserted into said mounting hole, so that said post means is non-rotatably mounted in said mounting hole thereby preventing rotation of said threaded fastener first component when said second fastener component is engaging said first component during installation of said pad assembly to said helmet shell; wherein said fastener further comprises a flange means located between the base means and the post means, said flange means being adapted to support said shell against said fastener.

11. A pad assembly as defined in claim 10, wherein said base means of said fastener comprises lateral extensions to prevent rotation of said fastener within said pad assembly.

12. A pad assembly as defined in claim 11, wherein said post part and said mounting hole serve as non-rotatable positioning and securement means between said pad assembly and said helmet shell.

13. A pad assembly as defined in claim 12, wherein said base means of said fastener comprises lateral extensions to prevent rotation of said fastener within said pad assembly.

14. A pad assembly as defined in claim 13, wherein the length of said post means is at most equal to the depth of said mounting hole in said helmet shell.

15. A protective helmet comprising an outer rigid helmet shell shaped to protect the top, rear, front and sides of a wearer's head, and an inner pad assembly, said pad assembly formed from a resilient foam material and comprising a back surface defining a helmet shell contacting surface, a front surface defining a wearer contacting surface, said pad assembly further comprising a threaded fastener extending through the back surface of said pad assembly, said fastener having base means embedded into said foam material for retaining said fastener to said pad assembly, a non-circular post means adapted to fit into a non-circular mounting hole in said helmet shell and capable of being inserted into said mounting hole, so that said post means is non-rotatably mounted in said mounting hole thereby preventing rotation of said threaded fastener during installation of said pad assembly to said helmet shell

16. A protective helmet as defined in claim 15, wherein said fastener further comprises a flange means located between the base means and the post means, said flange means adapted to support said helmet shell against said fastener.

17. A protective helmet as defined in claim 16, wherein said base means of said fastener comprises lateral extensions to prevent rotation of said fastener within said pad assembly.

18. A protective helmet as defined in claim 17, wherein said post part and said mounting hole serve as non-rotatable positioning and securement means between said pad assembly and said helmet shell.

19. A protective helmet as defined in claim 18, wherein said base means of said fastener comprises lateral extensions to prevent rotation of said fastener within said pad assembly.

20. A protective helmet as defined in claim 19, wherein the length of said post means is at most equal to the depth of said mounting hole in said helmet shell.

21. A pad assembly for use in a protective helmet shell, said pad assembly being formed from a resilient foam material and comprising a back surface defining a helmet shell contacting surface, a front surface defining a wearer contacting surface and defining a pad thickness, said pad assembly further including a threaded fastener which comprises a base portion defining a first end of said fastener, a non-circular post part defining a second opposite end of said fastener, and a support flange intermediate said base portion and said post part, wherein said base portion and said support flange are embedded in said pad assembly and said non-circular post part forms an upstanding projection which protrudes from said back surface of said pad assembly to be inserted into a non-circular mounting hole in said helmet shell to serve as a non-rotatable positioning and securement means between the pad assembly and said helmet shell.

22. A pad assembly according to claim 21, wherein the base portion of said fastener is non-circular.

23. A pad assembly according to claim 22, wherein said base portion of said fastener is rectangular.

24. A pad assembly according to claim 22, wherein said base portion comprises left, right, top and bottom segments which extend laterally outwardly in the form of a cross.

25. A pad assembly according to claim 21, wherein said post part is elliptical.

26. A pad assembly according to claim 21, wherein said post part is rectangular.

27. A pad assembly according to claim 21, wherein said securement means comprises a threaded screw.

28. A pad assembly according to claim 21, wherein the pad assembly includes a plurality of fasteners.

29. A pad assembly according to claim 21, comprising a plurality of pad assemblies.

30. A pad assembly according to claim 21, wherein said pad assembly is formed from a resilient, moldable, shock absorbing material.

31. A pad assembly according to claim 30, wherein the pad assembly material is a foamed styrene polymer.

32. A pad assembly according to claim 30, wherein the pad assembly material is a foamed urethane polymer.

33. A pad assembly according to claim 21, wherein said pad assembly has outer surfaces which have been treated to provide washable surfaces.

34. A pad assembly according to claim 21, wherein said pad assembly possesses a densified outer layer.

35. A pad assembly according to claim 22 wherein said post means part is obround.

36. A pad assembly for use in a protective helmet shell, said pad assembly being formed from a resilient material and comprising a back surface defining a helmet shell contacting surface, a front surface defining a wearer contacting surface, and side surfaces connecting said back and front surfaces and defining a pad thickness, said pad assembly further including a fastener which comprises a base portion defining a first end of said fastener, a non-circular post part defining a second opposite end of said fastener, and a support flange intermediate said base portion and said post part, wherein said base portion and said support flange are embedded in said pad assembly and said non-circular post part forms an upstanding protection which protrudes from said back surface of said gad assembly to serve as a non-rotatable positioning and securement means between the pad assembly and a mounting hole in said helmet shell, wherein said support flange of said fastener comprises a pair of laterally extending semi-circular surfaces which extend in a direction perpendicular to said base portion.

37. A protective helmet comprising an outer rigid helmet shell shaped to protect the top, rear, front and sides of a wearer's head, and an inner pad assembly, said pad assembly formed from a resilient foam material and surface defining a wearer contacting surface, said pad assembly further comprising a threaded fastener extending through the back surface of said pad assembly, said fastener having base means embedded into said foam material for retaining said fastener to said glad assembly, a non-circular post means adapted to fit into a non-circular mounting hole in said helmet shell and capable of being inserted into said mounting hole, so that said post means is non-rotatably mounted in said mounting hole thereby preventing rotation of said threaded fastener during installation of said pad assembly to said helmet shell; wherein said fastener further comprises a flange means located between the base means and the post means, said flange means adapted to support said helmet shell against said fastener.

38. A protective helmet as defined in claim 37, wherein said protective helmet comprises a front pad assembly and a rear pad assembly, each retained to said helmet shell by at least two threaded fasteners.

39. A protective helmet as defined in claim 38, wherein said rear pad assembly has a threaded fastener located on each side of the helmet in the lower part of a rear portion of said outer rigid helmet shell.

40. A protective helmet as defined in claim 39, wherein the length of said post means is at most equal to the depth of said mounting hole in said helmet shell.

41. A protective helmet as defined in claim 37, wherein said base means of said fastener comprises lateral extensions to prevent rotation of said fastener within said pad assembly.

* * * * *

UNITED STATES PATENT AND TRADEMARK OFFICE

CERTIFICATE OF CORRECTION

PATENT NO. : 6,202,223 B1
DATED : March 20, 2001
INVENTOR(S) : Daniel Chartrand

It is certified that error appears in the above-identified patent and that said Letters Patent is hereby corrected as shown below:

Claim 23, column 7,
Line 19, "claim 22" should read -- claim 21 -- ;

Claim 24, column 7,
Line 21, "claim 22" should read -- claim 21 -- ;

Claim 35, column 7,
Line 46, "claim 22" should read -- claim 21 -- ;

Claim 37, column 8,
Line 25, "glad" should read -- pad -- .

Signed and Sealed this

Twentieth Day of November, 2001

*Attest:*

Nicholas P. Godici

*Attesting Officer*

NICHOLAS P. GODICI
*Acting Director of the United States Patent and Trademark Office*